United States Patent [19]

Schweitzer et al.

[11] 4,319,535

[45] Mar. 16, 1982

[54] SPAR BASE

[75] Inventors: Henry H. Schweitzer, 317 Beirut, Pacific Palisades, Calif. 90272; Thane H. Roberts, Santa Monica, Calif.

[73] Assignee: Henry Hoyle Schweitzer, Torrance, Calif.

[21] Appl. No.: 148,881

[22] Filed: May 12, 1980

[51] Int. Cl.[3] ..... B63H 9/10

[52] U.S. Cl. ..... 114/91

[58] Field of Search ..... 9/310 E; 114/39, 90, 114/91, 89, 97–99, 218

[56] References Cited

U.S. PATENT DOCUMENTS 1,694,312 12/1928 Clark ..... 114/218

3,505,967 4/1970 Peterson ..... 114/90

FOREIGN PATENT DOCUMENTS 587098 4/1947 United Kingdom ..... 114/218

*Primary Examiner*—Sherman D. Basinger

*Attorney, Agent, or Firm*—Nilsson, Robbins, Dalgarn, Berliner, Carson & Wurst

[57] ABSTRACT

A base for the spar, i.e., mast, of a wind-propelled vehicle useful for attaching the spar, i.e., mast, to the universal joint which universal joint is further attached to the wind-propelled vehicle. The base has a cylindrical bore for receiving the spar, i.e., mast, in the upper portion thereof and the lower portion has an axially-located bore for the passage of a bolt which connects the lower end of the spar, i.e., mast, to a portion of the universal joint, and two line passages extending through the lower portion generally perpendicular to the longitudinal axis of the base, each having a pair of upper surfaces which slant inwardly downward towards the center of the passage and define a pair of grooves in the lower portion, with one of the grooves on one of the passages having a plurality of teeth on the opposed side walls thereof which grip and hold a line, acting as a jam cleat.

13 Claims, 7 Drawing Figures

SPAR BASE

BACKGROUND AND SUMMARY OF A PREFERRED EMBODIMENT OF THE INVENTION

In the past wind-propelled vehicles of the type shown in the patent to one of the present Applicants, Schweitzer, U.S. Pat. No. 3,487,800, the base of the spar, i.e., mast, which holds the sail of the vehicle is attached to a portion of a universal joint which mounts the spar, i.e., mast, to the wind-propelled vehicle by a bolt which extends through a portion of the universal joint and into the end of the spar. Typically an I-ring is screwed into the side of the spar, when the spar is made of wood, which is used for downhauling the sail to stretch the sail along the spar. The sail typically is formed with a sleeve at the spar end into which the spar is inserted.

When the spar is made of fiberglass, it is difficult to place the I-ring. Even when the spar is made of wood, the I-ring is subjected to a large amount of force when the user of the vehicle stretches the sail by running the downhaul line through the I-ring and pulling the sail downward with the downhaul line. Thus the I-ring can become loose and damage can occur to the spar, whether the spar is of wood or fiberglass. The present invention relates to an improvement in a base for the spar, i.e., mast of such a wind-propelled vehicle which provides a firm means for attaching the lower end of the spar to the universal joint and an improved means for downhauling the sail and locking the downhaul line in a desired position with the sail fully stretched over the spar.

The present invention thus relates to a base for the spar, i.e., mast, of a wind-propelled vehicle useful for attaching the spar, i.e., mast, to the universal joint which universal joint is further attached to the wind-propelled vehicle. The base has a cylindrical bore for receiving the spar, i.e., mast, in the upper portion thereof and the lower portion has an axially located bore for the passage of a bolt which connects the lower end of the spar, i.e., mast, to a portion of the universal joint, and two line passages extending through the lower portion generally perpendicular to the longitudinal axis of the base, each having a pair of upper surfaces which slant inwardly downward towards the center of the passage and define a pair of grooves in the lower portion, with one of the grooves on one of the passages having a plurality of teeth on the opposed side walls thereof which grip and hold the downhaul line, acting as a jam cleat.

The problems enumerated in the foregoing are not intended to be exhaustive, but rather are among many which tend to impair the effectiveness of previously known methods and apparatus for attaching the spar to the universal joint in a wind-propelled vehicle of the type shown in the patent to Schweitzer referred to above, the disclosure of which is hereby incorporated by reference. Other noteworthy problems may also exist; however, those presented above should be sufficient to demonstrate that prior art methods and apparatus for attaching the spar to the universal joint have not been altogether satisfactory.

The examples of the more important features of the present invention have been summarized rather broadly in order that the detailed description thereof that follows may be better understood, and in order that the contribution to the art may be better appreciated. There are, of course, additional features of the invention that will be described hereafter and which will also form the subject of the appended claims. These other features and advantages of the present invention will become more apparent with reference to the following detailed description of a preferred embodiment thereof in connection with the accompanying drawings, wherein like reference numerals have been applied to like elements, in which:

DETAILED DESCRIPTION OF A PREFERRED EMBODIMENT

Figure 1:
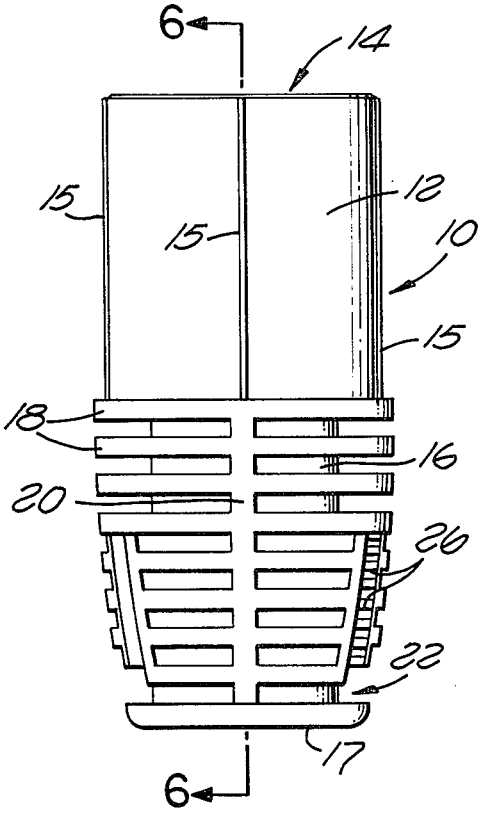
FIG. 1 shows a front elevational view of the mast base according to the present invention.

Turning now to FIG. 1, there is shown a mast base 10 according to the present invention which has a cylindrical upper portion 12 which has a mast-receiving bore 14 contained therein. The outer surface of the upper portion 12 has, spaced at 90 degrees intervals, support ridges 15.

The mast base has a lower portion 16 which is also generally cylindrical in shape and contains on the outer surface thereof a plurality of parallel support ribs 18 extending radially outward from the lower portion 16. A pair of support spines 20 extend longitudinally outward from the lower portion and interconnect the ribs 18. The lower portion has a bottom plate 17. Above the bottom plate, a pair of passage 22 extend through the lower portion generally perpendicular to the longitudinal axis of the spar base 10.

Figure 2:
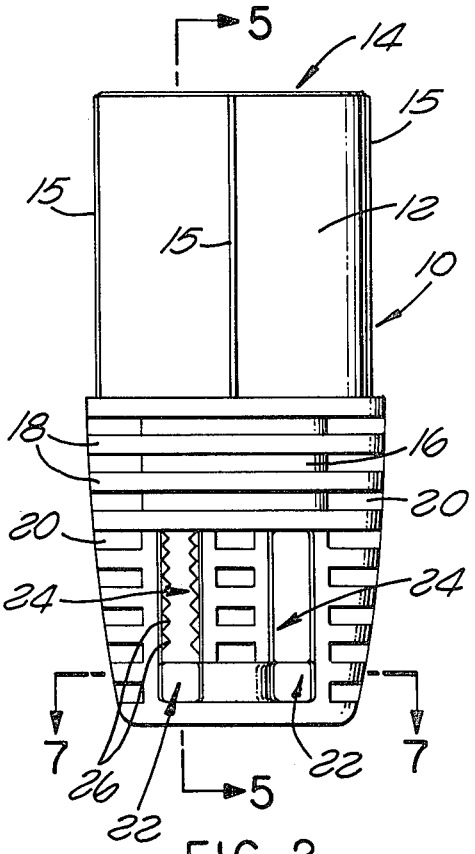
FIG. 2 shows a side elevational view of the mast base according to the present invention showing the two passages and the grooves extending vertically along the sides of the lower portion of the mast base.

As shown in more detail in FIG. 2, the spar base 10 is formed with longitudinally extending grooves 24 extending along the side of the lower portion and terminating in the respective one of the passages 22. A similar pair of 24 extend longitudinally along the lower portion 16 terminating at the ends of the passages 22 opposite from that shown in FIG. 2. One of the grooves 24 associated with one of the passages 22 has a plurality of teeth 26 on the opposed side walls thereof.

Figure 3:
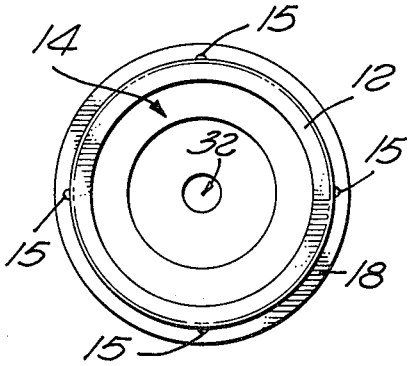
FIG. 3 is a top view of the mast base as shown in FIG. 1.
Figure 4:
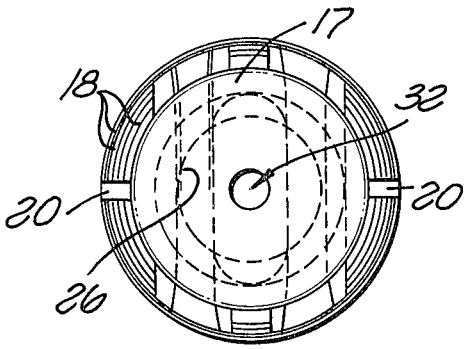
FIG. 4 is a bottom view of the mast base shown in FIG. 1.

As is shown in more detail in FIG. 3, the mast-receiving bore 14 extends through the entire upper portion 12 and narrows to a smaller inner diameter in the lower portion 16. A hole 32 is formed through the remainder of the lower portion 16 through which a bolt (not shown) is passed to attach the universal joint (not shown) to the terminal end of the spar (not shown) which extends into the spar-receiving bore 14.

Figure 5:
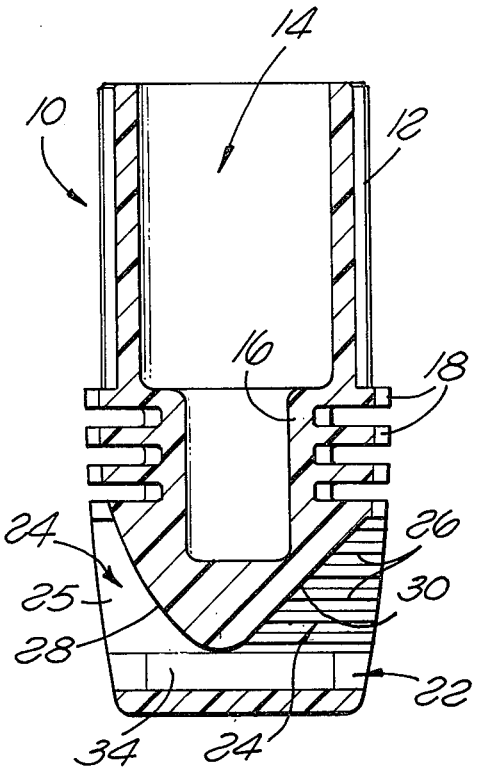
FIG. 5 is a cross-sectional view along lines 5—5 of FIG. 2 and shows the inwardly downward slanting sides of the grooves in the lower portion.
Figure 6:
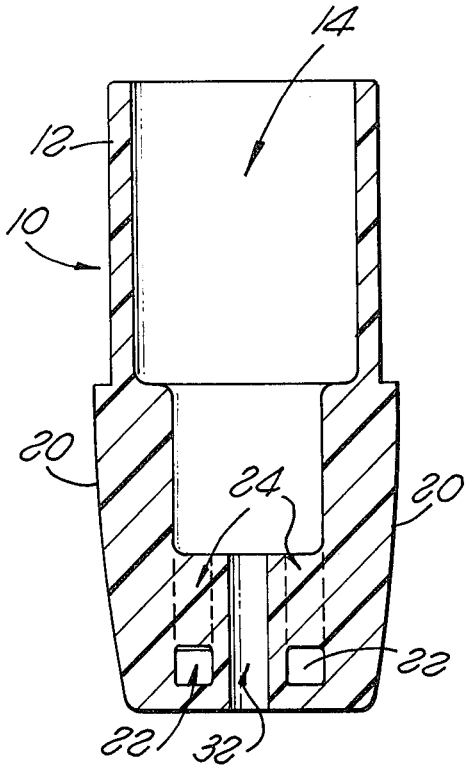
FIG. 6 is a cross-sectional view along lines 6—6 of FIG. 1.

Turning now to FIG. 5, the grooves 24 are shown to be formed by side walls 25 and a longitudinally inward slanting surface 28 or 30. Each of the three grooves 24 which do not have teeth 26 has a curved longitudinally inward slanting surface 28, while the inwardly slanting surface 30 of the groove 24 containing the teeth 26 is generally straight.

Figure 7:
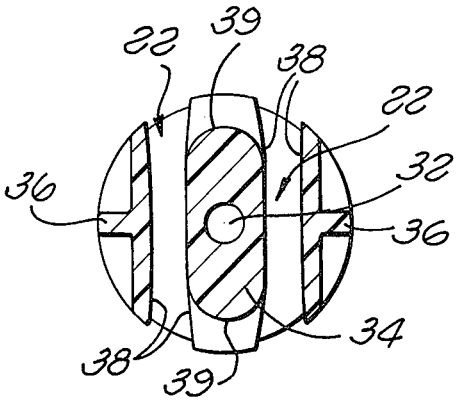
FIG. 7 is a cross-sectional view along lines 7—7 of FIG. 2 and shows the central column of the lower portion of the mast base and the passages having outwardly flaring edges at the ends thereof.

FIG. 7 shows that the passages 22 are defined between the side wall portions 36 of the lower portion 16 and a central column 34 of the lower portion 16 surrounding the mast bolthole 32. The sides 38 of the passages 22 flare outwardly towards the openings of the passages 22. The central column 34 has curved outer surfaces 39 at the opposed ends of the column 34 in the region of the openings of the passages 22.

In operation, the spar, i.e., mast, base 10 of the present invention receives the terminal end of the spar (not shown) to be attached to the universal (not shown) and a bolt (not shown), passing through the spar bolt bore 32 and into the terminal end of the spar (not shown), attaches the spar (not shown) to the universal joint (not shown).

The spar (not shown) is inserted into a sleeve on the sail (not shown) and a clew line (not shown) attached to the clew of the sail (not shown) is used in conjunction with the spar base 10 to stretch the sail (not shown) along the spar (not shown). One end of the clew line is made fast to the clew on the sail and passed through the passage 22 not having the groove 24 containing the teeth 26, and is then again passed through the clew of the sail and brought through the passage 22 which does have the groove 24 containing the teeth 26, from the opening of the passage 22 associated with the groove 24 having the curved surface 28. The curved surfaces 28 in the first passage 22 not associated with a groove 24 containing teeth 26, and in the second passage at the opposite end of the passage from the groove 24 containing the teeth 26, facilitate the user stretching the sail along the spar by providing a smooth bearing surface for the clew line to pass over as the user pulls on the clew line. The curved surfaces 39 of the central column 34, also facilitate fully stretching the sail by pulling the downhaul line taut and thus pulling down the clew of the sail along the spar. When the sail is fully stretched along the spar, the clew downhaul line is pulled vertically upward into the slot 24 containing the teeth 26, where the teeth 26 engage and grip the downhaul line and hold the clew of the sail in the desired position until the line is released from the teeth by jerking it downwardly.

The spar base according to the present invention is made suitably from a rigid plastic material, e.g., molded nylon.

SUMMARY OF THE ADVANTAGES AND SCOPE OF THE INVENTION

It will be appreciated that in constructing a spar base according to the present invention, certain significant advantages are provided.

In particular, the spar base bottom provides a platform which abuts the portion of the universal joint to which the spar base is attached. Also the spar-receiving bore supports the sides of the spar and prevents transverse motion between the spar and the portion of the universal joint, thereby preventing adverse forces on the bolt which attaches the spar to the universal joint.

The passages and slots, one of which contains the opposed rows of teeth, provide a simple and easy means for fully stretching the sail along the spar and locking the sail in the fully-stretched position. This eliminates the need for a threaded attachment, e.g., an I-ring, in the side of the spar for downhauling the sail along the spar.

The foregoing description of the invention has been directed to a particular preferred embodiment in accordance with the requirements of the patent statutes and for purposes of explanation and illustration it will be apparent, however, to those of ordinary skill in the art that many modifications and changes in both the apparatus and method of the present invention may be made without departing from the scope and spirit of the invention. These modifications will be apparent to those skilled in the art. It is Applicants' intention in the following claims to include all equivalent modifications and variations as fall within the true spirit and scope of the invention.

What is claimed is:

1. A spar base comprising:
   - a cylindrical tubular member having a spar-receiving bore therein at one end of the tubular member;
   - the opposite end of the tubular member having a first and a second passage therethrough extending generally perpendicular to the longitudinal axis of the tubular member;
   - each passage having associated therewith a pair of grooves in the tubular member, each formed between a pair of opposed side walls and a longitudinally inward slanting surface and opening into the respective one of the passages;
   - one of the grooves having on the opposed side walls thereof a plurality of teeth; and
   - a spar bolt bore extending axially through the opposite end of the tubular member.

2. The apparatus of claim 1 wherein the longitudinally inward slanting surfaces of each of the grooves not containing the teeth is a curved surface.

3. The apparatus of claim 2 wherein the tubular member has an upper portion and a lower portion and a plurality of radially outward extending support ribs and a pair of opposed longitudinally outward extending support spines interconnecting the support ribs.

4. The apparatus of claim 3 wherein each passage is defined between an end plate of the tubular member, an inward face of a section of the lower portion and a side wall of a central column of the lower portion.

5. The apparatus of claim 4 wherein the inward face of the section of the lower portion and the side wall of the central column flare outwardly towards each opening of the passage.

6. The apparatus of claim 2 wherein the tubular member has an upper and a lower portion and each passage is defined between an end plate of the tubular member, an inward face of a section of the lower portion and a side wall of a central column of the lower portion.

7. The apparatus of claim 6 wherein the inward face of the section of the lower portion and the side wall of the central column flare outwardly towards each opening of the passage.

8. The apparatus of claim 1 wherein the tubular member has an upper and a lower portion and the lower portion has a plurality of radially-outward extending support ribs and a pair of opposed longitudinally outward extending support spines interconnecting the support ribs.

9. The apparatus of claim 8 wherein each passage is defined between an end plate of the tubular member, an inward face of a section of the lower portion and a side wall of a central column of the lower portion.

10. The apparatus of claim 9 wherein the inward face of the section of the lower portion and the side wall of the central column flare outwardly towards each opening of the passage.

11. The apparatus of claim 1 wherein the tubular member has an upper and a lower portion and each passage is defined between an end plate of the tubular member, an inward face of a section of the lower portion and a side wall of a central column of the lower portion.

12. The apparatus of claim 11 wherein the inward face of the section of the lower portion and the side wall of the central column flare outwardly towards each opening of the passage.

13. The apparatus of claims 12, 7, 10 or 5 wherein the central column has a curved surface at each end thereof intermediate the respective openings of the first and second passages.

* * * * *